United States Patent [19]

Iten

[11] Patent Number: 4,972,968

[45] Date of Patent: Nov. 27, 1990

[54] TWO-PIECE DISPENSER FOR DOUBLE-EDGE RAZOR BLADES

[75] Inventor: Clemens A. Iten, Fisherville, Va.

[73] Assignee: American Safety Razor Company, Verona, Va.

[21] Appl. No.: 384,752

[22] Filed: Jul. 25, 1989

[51] Int. Cl.[5] ..... B65D 83/10

[52] U.S. Cl. ..... 221/97; 206/357; 206/359

[58] Field of Search ..... 206/355, 357, 358, 359; 221/97, 102, 303, 309; 30/40, 40.2

[56] References Cited

U.S. PATENT DOCUMENTS

| | | | |
|---|---|---|---|
| D. 162,283 | 3/1951 | Bowen et al. . | |
| D. 164,332 | 8/1951 | Shnitzler et al. . | |
| D. 233,598 | 11/1974 | Glaberson . | |
| 2,544,410 | 3/1951 | Young . | |
| 2,557,323 | 6/1951 | Testi . | |
| 2,562,115 | 7/1951 | Muros . | |
| 2,581,332 | 1/1952 | Testi . | |
| 2,617,520 | 11/1952 | Benedict, Jr. et al. . | |
| 2,646,874 | 7/1953 | Testi . | |
| 2,664,999 | 1/1954 | Young . | |
| 2,671,555 | 3/1954 | Shnitzler . | |
| 2,692,672 | 10/1954 | Shnitzler et al. . | |
| 2,692,674 | 10/1954 | Shnitzler et al. . | |
| 2,722,308 | 11/1955 | Sinclair . | |
| 2,776,743 | 1/1957 | Treiss | 221/102 |
| 2,830,414 | 4/1958 | Sinclair . | |
| 2,863,586 | 12/1958 | Testi . | |
| 2,946,431 | 7/1960 | Nissen . | |
| 3,071,856 | 1/1963 | Fischbein . | |
| 3,540,575 | 11/1970 | Holohan . | |
| 3,602,366 | 8/1971 | Dawidowicz . | |
| 3,774,805 | 11/1973 | Baker et al. . | |
| 4,073,407 | 2/1978 | Pentney . | |
| 4,311,234 | 1/1982 | Wildgoose . | |

*Primary Examiner*—H. Grant Skaggs
*Attorney, Agent, or Firm*—Nixon & Vanderhye

[57] ABSTRACT

A dispenser for double-edge razor blades includes a tray and a cover overlying the tray. The cover has side flanges for overlying the sides of the tray and inwardly extending projections for cooperating with inwardly directed locking surfaces on the tray to maintain the cover and tray in assembly. Openings are provided through the cover in registration with the inwardly extending projections such that the plastic molding of the cover can be accomplished without side action of mold parts. The tray includes a body portion and a pair of inwardly extending ledges spaced from the body portion defining a used blade compartment. The body portion has a pair of openings in registration with the ledges and having at least like lateral and longitudinal extent as the ledges whereby the tray may be molded without side action mold parts.

11 Claims, 2 Drawing Sheets

TWO-PIECE DISPENSER FOR DOUBLE-EDGE RAZOR BLADES

BACKGROUND AND SUMMARY OF THE INVENTION

The present invention relates to a dispenser for double-edge razor blades and particularly relates to a two-piece dispenser comprised of a cover and tray having constructional features which facilitate the plastic molding of the dispenser.

Dispensers for double-edge razor blades are well known in the art and are commercially successful. A typical double-edge razor blade dispenser is described and illustrated in U.S. Pat. No. 2,692,674. Such dispenser includes essentially two plastic molded parts, a cover and a tray. When the cover and tray are secured one to the other, they define a first or top dispensing compartment in which, prior to their assembly, a plurality of blades are disposed. The construction is such that the blades are conveniently dispensed alternately from the opposite ends of the dispenser. Also, there is provided a compartment along the underside of the tray for storing used razor blades, this second compartment having openings at either end for insertion of the used blades.

The cover and tray are conveniently secured one to the other by an interlocking rib and detent on the respective parts. For example, the tray may carry a laterally outwardly extending projection for reception in a corresponding groove along depending side flanges of the cover. Alternately, the cover may have depending flanges which carry laterally inwardly extending projections for receipt in one or more recesses formed along the sides of the tray. Also, to form the second compartment for the used blades, it is necessary to provide laterally inwardly projecting ledges or flanges or a complete bottom cover with openings at either end. It will be appreciated that such ledges or surface are closed by the upper surface of the tray.

Dispensers of this type are conventionally formed of a plastic molded material. In order to form the foregoing briefly described configurations, in each of the cover and the tray, it is essential that the mold parts have side actions. Thus, the mold parts require elements which move laterally of the mold parts, i.e., parallel to the parting line of the mold. For example, if the cover is provided with laterally inwardly extending flanges for detenting engagement with locking surfaces on the tray, the volume between the flanges and the top surface of the cover must be occupied during molding by a part which can be withdrawn sideways relative to the parting line of the mold. Otherwise, the molded cover cannot be removed from the mold. Likewise, the ledges or bottom surface of the tray heretofore cannot be formed without mold parts having this side action.

As is well recognized in the plastic molding industry, side action on molding machines increases the cycle time for molding the parts. A consequence of increased molding time is, of course, lower production rates for a given mold. It will be appreciated that dispensers for double-edge razor blades are manufactured in the millions and that, therefore, it is desirable to reduce the cycle time for molding the plastic parts whereby higher production rates can be achieved.

Additionally, the blades are alternately staggered in assembly. In most commercial dispensers, arrows are provided on the blades visible through the thumb window of the cover to indicate the direction in which the next blade will be removed from the dispenser. In certain assembly machines for disposing the blades in the dispenser, the tray is passed continuously in one direction under a series of blade feeders, one for each blade count. It is therefore important that the blades can be picked off from the feeders in an alternating sequence.

According to an aspect of the present invention, there is provided a cover and a tray for assembly into a dispenser for double-edge razor blades, the cover and tray being constructed to facilitate molding thereof of plastic material without mold parts which use any side action. To accomplish this, the present invention provides a dispenser, including a cover and a tray, which, when assembled, define as in the prior art, a first compartment for storing unused razor blades. A second compartment is provided in the tray for storing used razor blades. The cover is also provided with depending flanges for engaging along the sides of the tray, the flanges having laterally inwardly projections for engaging locking surfaces carried by the tray. However, in accordance with the present invention, the cover additionally is provided with a plurality of openings or windows respectively overlying and in registration with each of the laterally inwardly extending projections. The openings through the cover extend laterally and longitudinally distances at least corresponding to the lateral and longitudinal extents of the underlying projection. When forming the cover, a part of the fixed mold projects to form each opening or window and extends up to the interior surface of the laterally inwardly extending projection opposite the cover. The mold part is, of course, preferably tapered and the corresponding window will likewise be tapered. In this manner, the cover of the dispenser can be released from the fixed mold part by pushing the cover off the part or vice-versa, the taper of the mold part facilitating release of the cover. The mold part thus occupies the space between the locking surface of the projection and the interior surface of the cover yet does not inhibit or require side action of any part of the mold to form the cover or disengage the cover from the mold.

In a similar manner, the ledges on the bottom of the tray and which define in part the second compartment for storing used razor blades, may be formed without side action of mold parts. To accomplish this, the overlying surface of the tray which forms the upper surface of the used blade compartment (and also the underside of the unused blade compartment) is provided with openings or windows which overlie and lie in registry with the ledges. Thus, to form the ledges and the space between the ledges and the overlying surface, mold parts, preferably slightly tapered, project from the mold to form the openings and extend inwardly to occupy the area between the ledges and the upper surface. Thus, the tray can be removed from the mold without side action of any mold parts simply by pushing the tray unidirectionally off the mold or vice-versa.

Additionally, in accordance with another aspect of the present invention, there is provided a pair of openings along the longitudinal centerline of the dispenser and disposed in spaced relation one from the other on opposite sides of the lateral centerline of the dispenser. By providing such openings, a jig fixture may be used when loading the tray with razor blades. Thus, the fixtured tray would pass continuously in a single direction under a series of blade feeders and a fixture pin would project through the slots to pick off every other blade.

In a preferred embodiment according to the present invention, there is provided a dispenser for double-edge razor blades, comprising a tray and a cover overlying the tray, the tray and cover defining a first compartment for storing unused double-edge razor blades, and defining a blade outlet for dispensing blades from the compartment. Means are carried by the tray defining a second compartment for storing used blades, together with an opening for receiving used blades into the second compartment. The cover has depending side flanges for overlying opposite side faces of the tray, respectively, together with means defining a locking surface along each side of the tray. Each flange of the cover carries a laterally inwardly extending projection for engaging the locking surface on the corresponding side of the tray to secure the tray and cover one to the other. The cover has an opening therethrough on each of its opposite sides in registration with the underlying projection on the flange, the cover having a lateral extent at least corresponding to the lateral extent of projection.

In a still further preferred embodiment according to the present invention, there is provided a dispenser for double-edge razor blades, comprising a tray and a cover overlying the tray, the tray and the cover defining a first compartment for storing unused double-edge razor blades, and defining a blade outlet for dispensing blades from the compartment. Means are carried by the tray defining a second compartment for storing used blades, together with an opening for receiving used blades into the second compartment. The tray has a body portion extending substantially between the opposite ends and the opposite sides of the tray and a pair of laterally inwardly extending ledges are spaced laterally one from the other and spaced from the body portion to define at least in part with the body portion the second compartment. The body portion has a pair of openings accessible from the opposite side thereof from the ledges and in registration with the ledges, the latter openings each having a lateral extent at least corresponding to the lateral extent of its registering ledge.

Accordingly, it is a primary object of the present invention to provide a novel and improved dispenser for double-edge razor blades which can be readily and easily formed of plastic materials in molds without mold parts employing side action.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to the present preferred embodiment of the invention, an example of which is illustrated in the accompanying drawings.

Figure 1:
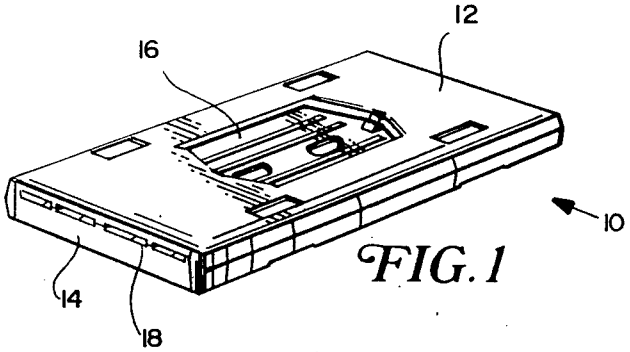
FIG. 1 is a perspective view of a dispenser for double-edge razor blades according to the present invention.
Figure 7:
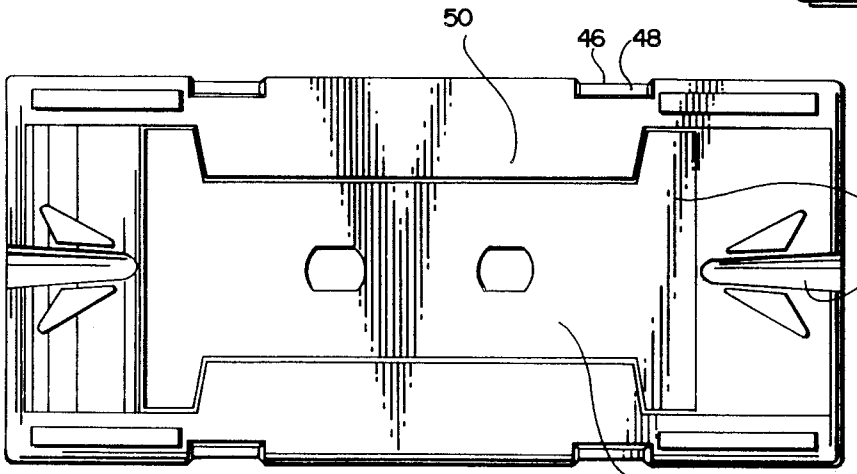
FIG. 7 is an enlarged bottom plan view of the tray illustrated in FIG. 6.

Referring now to the drawings, particularly to FIG. 1, there is illustrated a dispenser, generally designated 10, for dispensing double-edge razor blades, not shown. Dispenser 10 is comprised of two parts, a cover 12 and a tray 14. The cover 12 and tray 14 in assembly define a compartment 16 for storing unused razor blades. The compartment 16 includes a slot 18 at each of the opposite ends of the dispenser and defined by end portions of the cover and tray whereby the blades in the first compartment 16 may be alternately dispensed through slots 18 from opposite ends of dispenser 10. In FIG. 7, the underside of the tray 14 is provided with a second compartment 20 for storing used blades in the manner which will become clear from the ensuing description.

Figure 2:
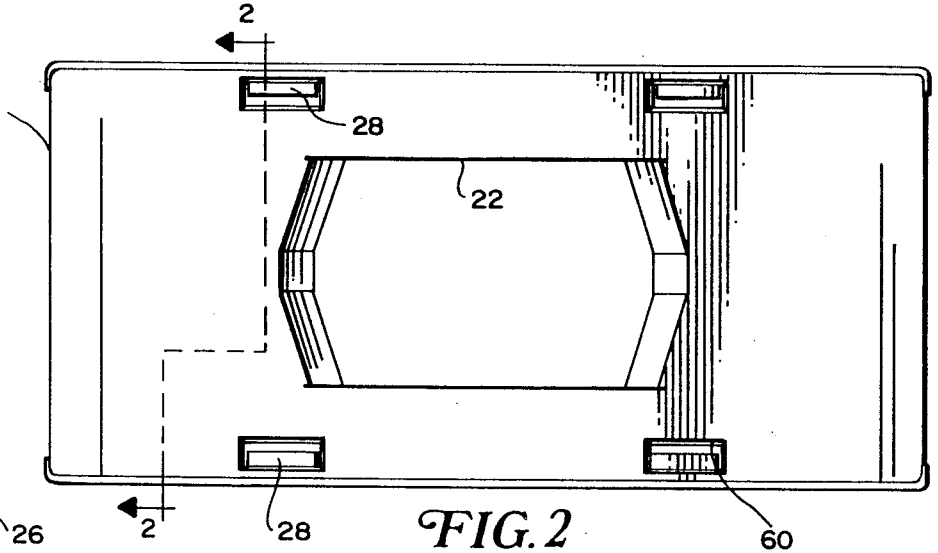
FIG. 2 is an enlarged top plan view of the dispenser illustrated in FIG. 1.
Figure 3:
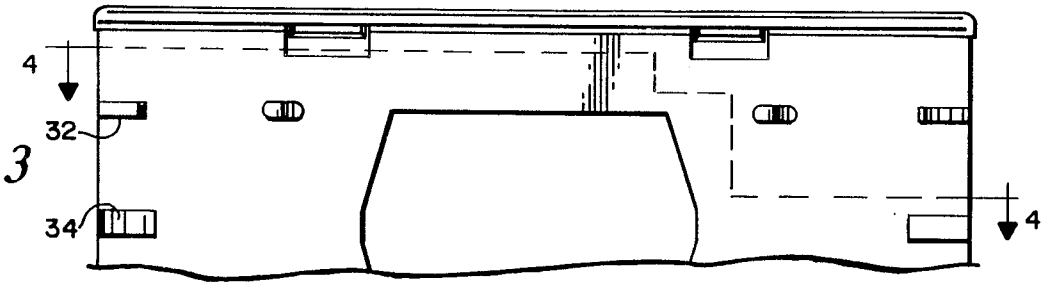
FIG. 3 is an enlarged fragmentary bottom plan view of the cover illustrating one of the side flanges, the projections and the windows.
Figure 4:
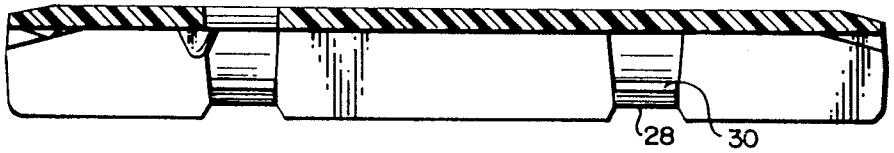
FIG. 4 is a cross-sectional view thereof taken generally about on lines 4—4 in FIG. 3.
Figure 5:
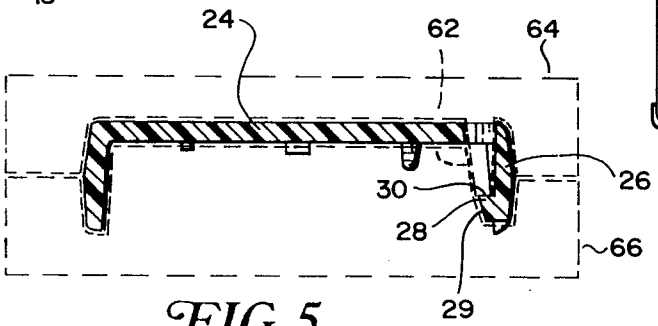
FIG. 5 is a cross-sectional view of the cover with the dashed lines schematically indicating the mold parts from which the plastic cover is formed.

Referring now to the drawing Figures, particularly to FIGS. 2 through 5, cover 12 includes a central opening or window 22 which exposes the blades stored in storage compartment 16 for manual movement, for example, by a thumbing action, toward one or the other ends of dispenser 10 for dispensing the top blade exposed in window 22 through an end slot 18. Referring to FIG. 5, it will be appreciated that cover 12 includes a substantially flat upper surface through which the window 22 is formed and a pair of depending side flanges 26. For purposes of securing the cover to the tray in a manner set forth in the ensuing description, each side flange 26 is provided with at least one, and preferably two, laterally inwardly extending projections 28. As illustrated in FIGS. 2 through 4, the projections 28 thus lie on opposite sides of the longitudinal centerline of the dispenser, as well as on opposite sides of the transverse centerline of the dispenser. Each projection 28 includes a locking surface 30 which is in direct opposition to the underside of the cover. The underside of the surface 24 is also provided with a plurality of projections 32 and 34 (FIG. 3) for bearing against the blades disposed in dispensing compartment 16. Projections 32 and 34 are provided at opposite ends for cooperation with matching projections on the tray to define the end slots 18 through which the blades are dispensed. The projections 28 are also provided with inwardly extending tapered surfaces 29, for reasons apparent from the ensuing description.

Referring now to the tray 14 illustrated in FIGS. 6–9, tray 14 includes a central body portion 36, the upper surface 38 of which is ruled at 40 to provide a surface on which the underside of the last blade to be dispensed rests. Body portion 36 is substantially coextensive in length and width with the dispenser. Upwardly angled central projections 40 are provided at opposite ends of surface 38 and upstanding ribs 42 straddle portions 40 adjacent the opposite ends. These ribs cooperate with the ribs 32 or cover 12 while the projections 40 cooperate with projections 34 on cover 12 cooperate to define a slot 18 at each of the opposite ends of the dispenser.

Along the opposite sides of tray 14, there are provided at like longitudinal positions therealong as projections 28 or cover 12, a pair of recesses 46 having downwardly facing locking surfaces 48. Thus, it will be appreciated that, when cover 12 and tray 14 are assembled, projections 28 on cover 12 will engage in recesses 46 below locking surfaces 48 whereby the two locking surfaces of the cover and tray 30 and 48, respectively, cooperate to maintain the cover and tray in assembled relation with the blades in the first compartment 16.

With reference to FIG. 7, the underside of tray 14 is provided with a pair of laterally inwardly extending ledges 50 spaced transversely one from the other whereby the undersurface of portion 36 is exposed through the bottom of the tray in the absence of used blades in compartment 20. The portion 36 also includes a downwardly projecting rib 52 at each of its opposite ends and slots 54 for receiving used razor blades. Consequently, it will be appreciated that, by inserting a used razor blade through slot 54 below ledges 50 on top of the undersurface portion 36, the blades may be retained in the used blade compartment 20.

In accordance with the present invention, the molding of the parts described herein of plastic materials is effected by mold parts which do not require side action in order to release the cover and tray during molding. To accomplish this, and with reference to FIGS. 2 through 5, openings 60 are provided in cover 12 in registration with the projections 28. The openings 60 extend longitudinally and laterally distances corresponding at least to the longitudinal and lateral extent of projections 28. Preferably, however, openings 60 are slightly larger in both longitudinal and transverse directions as compared with projections 28 in order to receive a tapered mold part 62 (FIG. 5). Additionally, the openings 60 are tapered in a direction toward projections 28.

Referring to FIG. 5, two mold parts 64 and 66 are illustrated, constituting the opposite sides of the mold for forming the cover 12. The mold part 64 includes the projections 62 for forming the openings 60 as well as for occupying the volume or space between locking surfaces 30 and the underside of the cover. Thus, where side action of a mold part would normally be required to form each locking surface 30 in opposition to surface 24 of cover 12, the cover 12 may be removed from mold part 64 without side acting mold parts simply by pushing the cover off mold part 64 in the direction of the opposite mold part 66. Thus, the openings 60 are provided to eliminate the prior necessity of side acting mold parts in the molding process.

Figure 9:
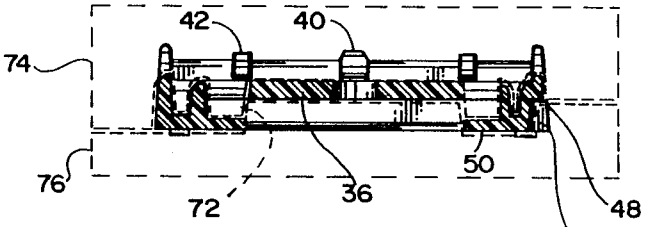
FIG. 9 is a cross-sectional view of the tray illustrated in FIG. 6, with the dashed lines schematically illustrating the mold parts from which the plastic tray is formed.
Figure 8:
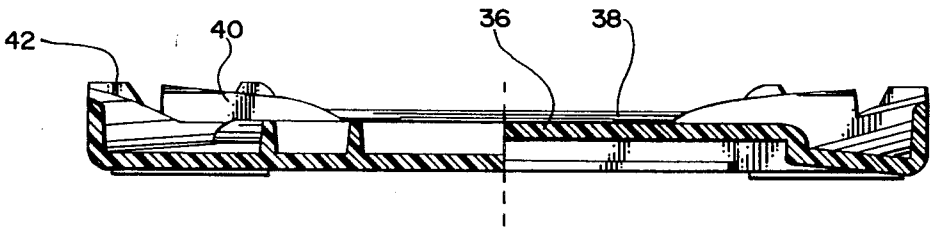
FIG. 8 is a longitudinal cross-sectional view of the tray taken generally about on lines 8—8 in FIG. 6.

Similarly, referring to FIGS. 6–9, openings or windows 70 are formed in the central portion 36 of tray 12 in opposition or registration with the ledges 50 formed along its underside. The openings 70 have a longitudinal and lateral extent at least corresponding to the longitudinal and lateral extent of ledges 50. Preferably, the openings 70, however, are slightly larger in longitudinal and lateral extent than the ledges 50 in order to permit tapered mold pins, for example, the tapered mold pins 72 illustrated in FIG. 9, to be received within openings 70, respectively. In FIG. 9, the mold parts 74 and 76 are illustrated by the dashed lines and the tapered mold pins 72 project from mold part 74 toward mold part 76 and through the opening 70. In this manner, the tray 14 may be displaced away from mold part 74 without any side action and toward the mold part 76. It will be appreciated that the areas between portion 36 and ledges 50 are thus occupied by the mold pins 72 during the molding process. Note that the areas underlying ledges 50 will house the sharp cutting edges of the used razor blades but that such areas are enclosed by cover 12 so that the blade edges are not exposed through the openings 70. Consequently, such sharp edges are wholly confined within the interior of the dispenser and are not exposed.

Figure 6:
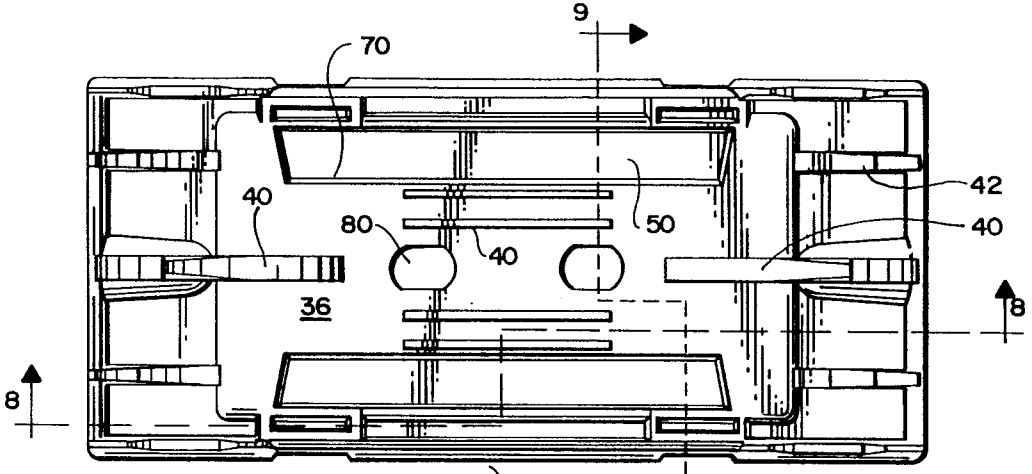
FIG. 6 is an enlarged plan view of a tray forming part of the dispenser hereof.

Additionally, and with reference to FIGS. 6 and 7, a pair of openings 80 are disposed along the longitudinal centerline of the dispenser through portion 36 and are spaced one from the other on opposite sides of the transverse centerline of the dispenser. These openings are provided such that a jig fixture can be inserted through such openings to facilitate the placement of the blades in the first storage compartment so that they may be dispensed alternately through the opposite end slots 18.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A dispenser for double-edge razor blades, comprising:

a tray having two opposite sides and a cover overlying said tray;

said tray and said cover defining a first compartment for storing unused double-edge razor blades, and means defining a blade outlet for dispensing blades from said compartment;

means carried by said tray defining a second compartment for storing used blades, and means defining an opening for receiving used blades into said second compartment;

said cover having depending side flanges for overlying opposite side faces of said tray, respectively;

means defining a locking surface along each side of said tray;

each flange of said cover carrying a laterally inwardly extending projection for engaging the locking surface on the corresponding side of said tray to secure the tray and cover one to the other;

said cover having an opening therethrough on each of its opposite sides in registration with the underlying projection on said flange and having a lateral extent at least corresponding to the lateral extent of said projection.

2. A dispenser according to claim 1 including means defining a second locking surface along each side of said tray and spaced from the first mentioned locking surface, a second laterally inwardly extending projection carried by each said flange spaced from the first mentioned projection for engaging said second locking surface on the corresponding side of said tray, and wherein said cover has an additional opening therethrough on each of its opposite sides in registration with the underlying second projection and having a lateral extent at least corresponding to the lateral extent of said underlying second projection.

3. A dispenser according to claim 1 wherein each said locking surface includes a projection extending laterally outwardly of the side of said tray such that the laterally inwardly extending projections on said cover flanges underlie the laterally outwardly extending projections of said tray when said tray and said cover are secured one to the other.

4. A dispenser according to claim 3 including means defining a second locking surface along each side of said tray and spaced from the first mentioned locking surface, a second laterally inwardly extending projection carried by each said flange spaced from the first mentioned projection for engaging the locking surface on the corresponding side of said tray and wherein said cover has an additional opening therethrough on each of its opposite sides in registration with the underlying second projection and having a lateral extent at least corresponding to the lateral extent of said underlying second projection.

5. A dispenser according to claim 4 wherein the lateral and longitudinal extent of each opening is greater than the lateral and longitudinal extent of the corresponding projection.

6. A dispenser according to claim 1 wherein said second compartment defining means includes a body portion of said tray extending substantially between opposite ends and the opposite sides of said tray, said tray having a pair of laterally inwardly extending ledges spaced laterally one from the other and spaced from said body portion defining at least in part with said body portion the second compartment, said body portion having a pair of openings accessible from the opposite side thereof from said ledges and in registration with said ledges, the latter openings each having a lateral extent at least corresponding to the lateral extent of the registering ledge.

7. A dispenser according to claim 6 wherein each of said tray openings has a lateral and longitudinal extent larger than the respective lateral and longitudinal extent of its registering ledges.

8. A dispenser according to claim 1 wherein said tray has a pair of openings longitudinally spaced one from the other and lying on opposite sides of a transverse centerline of said tray.

9. A dispenser for double-edge razor blades, comprising:

a tray and a cover overlying said tray;

said tray and said cover defining a first compartment for storing unused double-edge razor blades, and means defining a blade outlet for dispensing blades from said compartment;

means carried by said tray defining a second compartment for storing used blades, and means defining an opening for receiving used blades into said second compartment;

said tray having a body portion extending substantially between the opposite ends and the opposite sides of said tray and a pair of laterally inwardly extending ledges spaced laterally one from the other and spaced from said body portion to define at least in part with said body portion the second compartment, said body portion having a pair of openings accessible from the opposite side thereof from said ledges and in registration with said ledges, the latter openings each having a lateral extent at least corresponding to the lateral extent of its registering ledge.

10. A dispenser according to claim 9 wherein said openings in said body portion each have a lateral and longitudinal extent larger than the respective lateral and longitudinal extent of its registering ledge.

11. A dispenser according to claim 9 wherein said ledges extend substantially the entire longitudinal extent of said second compartment, said openings in said body portions each having a longitudinal extent at least corresponding to the longitudinal extent of its registering ledge.

* * * * *